United States Patent [19]

Vogt

[11] 4,032,210

[45] June 28, 1977

[54] ELECTRICAL SPLICE

[76] Inventor: Kuno J. Vogt, 5854 Kantor Court, San Diego, Calif. 92122

[22] Filed: June 10, 1976

[21] Appl. No.: 694,801

[52] U.S. Cl. ..... 339/98; 339/99 R

[51] Int. Cl.[2] ..... H01R 13/38

[58] Field of Search ..... 339/93–100

[56] References Cited

UNITED STATES PATENTS

| | | | |
|---|---|---|---|
| 1,956,020 | 4/1934 | Gilbert | 339/97 R |
| 3,745,228 | 7/1973 | Vogt | 339/98 |
| 3,786,173 | 1/1974 | Vogt | 339/98 |

FOREIGN PATENTS OR APPLICATIONS

| | | | |
|---|---|---|---|
| 968,232 | 11/1950 | France | 339/99 R |

*Primary Examiner*—Joseph H. McGlynn
*Attorney, Agent, or Firm*—Charles C. Logan, II

[57] ABSTRACT

An electrical splice having first and second identical, symmetrical, mating, insulative parts with channels therein for receiving first and second pairs of conductors, respectively, and an insulative center member consisting of a cylinder with hollow end sections and a solid center section; the solid center section having first and second shorting pins disposed therethrough for electrical connection with the first and second pairs of conductors, respectively, the first and second identical, insulative parts having opposite flat recesses therein with the remainder being dimensioned for being slidably received by said hollow end sections of said center member and having first and second protuberances for cooperation with first and second apertures on each end of said center member for locking the entire assembly into place, the splice being disassembled by displacing the cylinder portions of center member hollow portions into the flat recesses of the identical, insulative parts for allowing the walls of the cylindrical apertures to extend outwardly beyond the protuberances.

8 Claims, 7 Drawing Figures

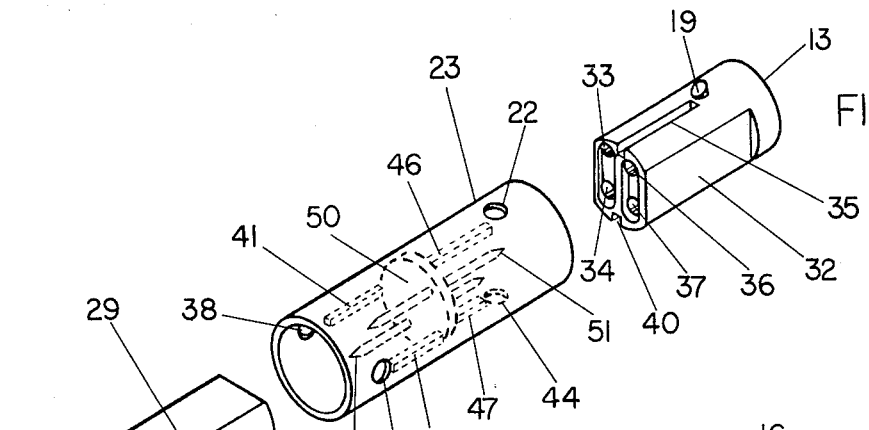
FIG. 2
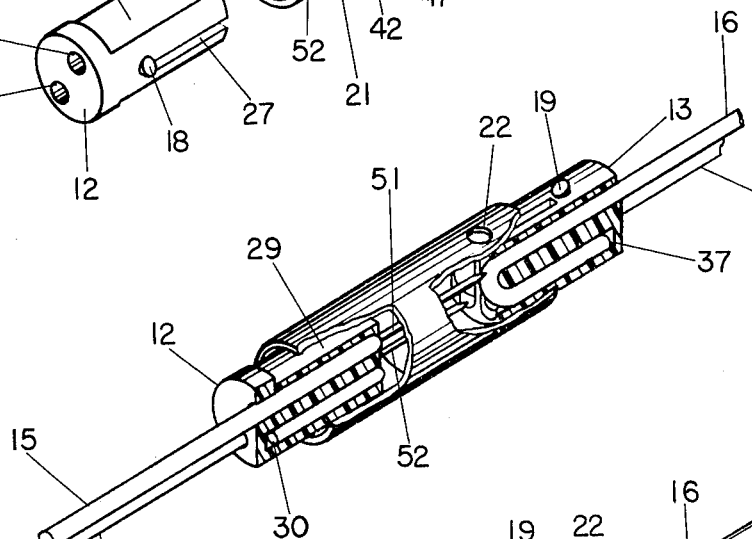
FIG. 3
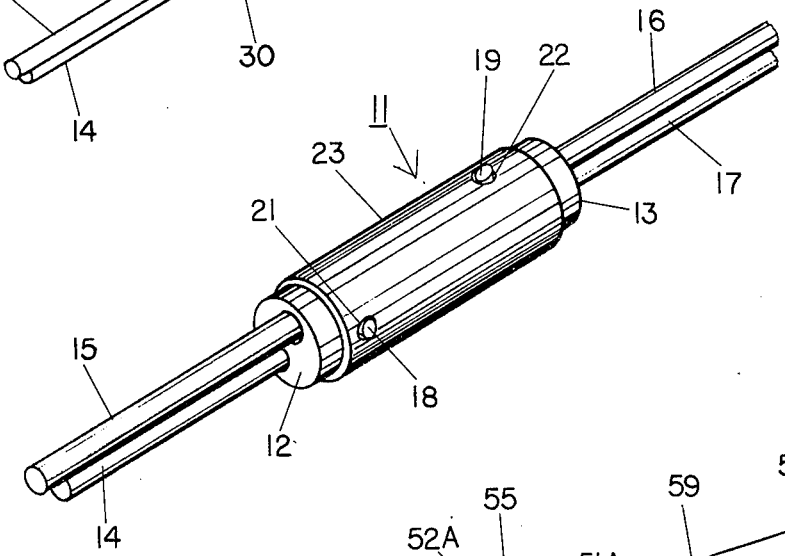
FIG. 1
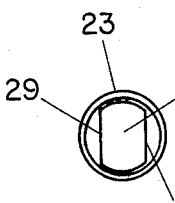
FIG. 4
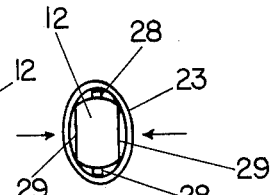
FIG. 5
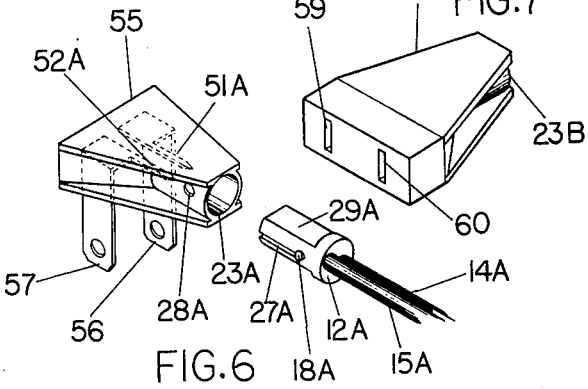
FIG. 6
FIG. 7

ELECTRICAL SPLICE

RELATED PATENTS

U.S. Patent for an Electrical Splice issued Jan. 1, 1972, to KUNO J. VOGT, U.S. Pat. No. 3,786,173, has an identical electrical splice connective combination but is totally different in mechanical locking and unlocking means.

BRIEF DESCRIPTION OF THE INVENTION

The present invention relates to an electrical splice, and, more particularly, to an electrical splice which will assembly in only the correct manner, and, more specifically, to an electrical splice with unique locking and unlocking means.

According to the invention, an electrical splice is provided having first and second identical end members for receiving first and second pairs of electrical conductors, a center member carrying first and second shorting pins for shorting the first and second conductors of each pair to the first and second conductors of the other pair, respectively. In this regard, the above-referenced patent issued to the instant inventor is identical in every respect regarding the electrical connecting parts. It has been found, empirically, however, that the locking and unlocking means of the above-referenced patent resulted in a difficult and awkward maneuver on the part of the user. The instant invention is directed to an improvement over the locking and unlocking means of the splice of U.S. Pat. No. 3,786,173. The center member comprises a cylinder with hollow end sections and a solid central section through which the shorting pins are mounted. The center section also has at least one mounting aperture in each hollow end section thereof for cooperation with at least one mounting protuberance extending from the sides of the first and second end members. The hollow end sections each have a key extending inwardly from the inner walls of the hollow sections for cooperation with slots in the end members to assure proper alignment. The end members have flat surface recesses between the locking protuberances which, after assembly, allow the cylindrical sections to be displaced therein, moving the walls of the hollow sections exterior of the protuberances to permit easy withdrawal of either or both end members.

An object of the present invention is the provision of an improved electrical splice.

Another object of the invention is the provision of an electrical splice having a minimum of parts.

A further object of the invention is the provision of an electrical splice which can only be assembled in a correct manner.

Yet another object of the present invention is the provision of an electrical splice which facilitates convenient disassembly.

Other objects and many of the attendant advantages of the present invention will be readily appreciated as the same becomes better understood by reference to the following detailed description when considered in connection with the accompanying drawings in which like reference numerals designate like parts throughout the Figures thereon and wherein:

FIG. 1 is a perspective view of the completed splice in the preferred embodiment of the invention;

FIG. 2 is an exploded view of the body of the embodiment of FIG. 1;

FIG. 3 is a perspective view partially broken away and partially sectioned of the embodiment of FIG. 1;

FIG. 4 is a schematic view showing mechanical coupling of the splice;

FIG. 5 is a schematic view showing mechanical uncoupling of the splice;

FIG. 6 is a perspective view of a modification of the embodiment of FIG. 1; and

FIG. 7 is a perspective view of another modification of FIG. 1.

DETAILED DESCRIPTION OF THE DRAWING

Referring to FIG. 1, the assembled splice of the present invention is shown generally at 11 having identical insulative end members 12 and 13, receiving insulated conductor pairs 14, 15, and 16–17, respectively. End members 12 and 13 are slidably received by insulative center member 23. End member 12 has a locking protuberance 18 and end member 13 has a locking protuberance 19. Locking protuberances 18 and 19 are disposed within locking apertures 21 and 22, respectively in insulative center member 23.

Referring to FIG. 2, end member 12 has conductor apertures 25 and 26 with a guide recess 27 terminating in locking protuberance 18. End member 12 has a flat recess 29 therein.

Insulative end member 13 has guide recesses 35 and 40 and locking protuberance 19. End member 13 has a flat recess 32. Conductor channels 33 and 34 are for the insertion and capture of conductor 17 (FIG 1) and conductor channels 36 and 37 are for the reception and capture of conductor 16 (FIG. 1).

Insulative center member 23 has locking apertures 38 and 21 at one hollow end with identical locking apertures 22 and 44 at the other end. Locking apertures 21 and 22 cooperate with protuberances 18 and 19 of end members 12 and 13, respectively. Key extensions 41 and 42 cooperate with guide recess 27 and an identical guide recess opposite guide recess 21 (not shown) in end member 12 and key extensions 46 and 47 cooperate with guide recesses 35 and 40, respectively, in end member 13. Solid center section 50 in insulative center member 23 carry shorting pins 51 and 52. Shorting pin 51 shorts conductors 14 and 16 (FIG. 1) and shorting pin 52 shorts conductors 15 and 17 (FIG. 1).

Referring to FIG. 3, the splice is shown partially assembled with conductors 14, 15, 16, and 17 placed within their respective channels in end members 12 and 13. Here, conductor 14 is shown passing into channel 26 with conductor 14 passing through channel 26 and into channel 30. Conductor 16 is passing into channel 37 in end member 13. It can be seen that shorting pin 51 is in a position for shorting conductors 14 and 16 together.

Referring to FIG. 4, end member 12 is shown having flat recesses 29 thereon and disposed within one hollow end portion of center member 23.

Referring to FIG. 5, center member 23 is shown distorted by exerting pressure at the arrows allowing its end portion to free locking protuberances 18 on end member 12.

Referring to FIG. 6, a male plug is shown generally at 55 carrying hollow cylindrical insulative section 23A in spatial relationship to an end member 12A and having a locking aperture 28A for cooperation with locking protuberances 28A of an end member 12A. Male prongs 56 and 57 are electrically coupled to shorting prongs 51A and 52A, respectively, of male plug 55. End member 12A receives conductors 14A and 15A and has a guide recess 27A therein.

Referring to FIG. 7, a female plug is shown generally at 56 having a partial insulative center member 23B with female receptacles 57 and 58 therein.

ASSEMBLY

Referring back to FIGS. 1–5, the two end sections 12 and 13 are identical and symmetrical, as can be seen in FIG. 3. Conductor 16 is passed through the top channel 36 and then threaded through the bottom part of channel 37 as shown. Each of the other conductors shown have identical channels through which they are passed. For example, conductor 14 passes through channel 25 in FIG. 1 and circles around through channel 30 in FIG. 3. Conductor 15 has an identical channel on the other side which is not shown. Conductor 17 has identical channels to conductor 16. When the conductors have been threaded in their channels in end members 12 and 13, the end members 12 and 13 are then slidably received within the hollow end portions of center member 23 with key extensions 41, 42, 46, and 47, entering guide recesses 27, 35, and 40 (the recess for key extension 41 not being shown) slidably guiding the parts together until protuberance 18 snaps into locking aperture 21 with an identical protuberance on the other side snapping into locking aperture 38 and protuberance 19 snapping into locking aperture 44. At this time, shorting pin 51 has shorted conductors 16 and 15 together and shorting pin 42 has shorted conductors 14 and 17 together completing the splice.

Referring to FIGS. 4 and 5, it can be seen that the hollow ends of center member 23 can be pinched together as shown in FIG. 5, allowing the inner walls of center member 23 to clear locking protuberances 18 and the unit and end member 12 slidably removed from center member 23. The identical action, of course, would take place with respect to end member 13. In this regard, it is pointed out that center member 23 is constructed of resilient insulative material such as plastic.

Referring to FIG. 6, a male wall plug adaptation of the present invention is shown where the center member is halved and shown at 23A and mounted in the center of a plug body 55. Plug body 55 is preferably constructed of a resilient plastic material so that when end member 12A is received by center member 23A, conductive pins 51 and 52A complete a splice between male prongs 56 and 57 and insulated conductors 14A and 15A, rspectively, exactly as shown in FIG. 3 but only on one end thereof. The locking mechanism is identical with a guide recess 27A cooperating with key extension (not shown) on the inside wall of center member 23A and locking protuberance 28A cooperating with locking aperture 21A.

Referring back to FIG. 7, the identical construction is contemplated as that of FIG. 6 with the exception that male prongs 56 and 57 are replaced by female receptacles 59 and 60. Here, the action is identical with a half-center member 23B ready to receive an end member identical to 12A of FIG. 6. In both the embodiments of FIGS. 6 and 7, the body 55 and 58 are constructed of a resilient plastic with side recesses for displacing half-center 23A and 23B into the flat portions of the end members to allow protuberances 28A to be withdrawn.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

I claim:

1. An electrical connector comprising:
   - a first insulative member;
   - first and second channels in said first insulative member dimensioned for receiving first and second conductors to be spliced;
   - first and second recesses in said first insulative member dimensioned for receiving said first and second conductors after passage through said first and second channels;
   - first and second protuberances disposed on opposite sides of said first insulative member;
   - a second resilient insulative member, said second insulative member having a recess one one end thereof dimensioned for receiving said first insulative member;
   - first and second conductive pins carried by said second insulative member and being geometrically disposed for electrical contact with any conductors disposed in said first and second recesses, respectively;
   - first and second apertures in said second insulative member geometrically disposed for receiving said first and second protuberances, respectively; and
   - electrical output means coupled to said first and second conductive pins.

2. The electrical connector of claim 1 and further including:
   - first and second flat recesses disposed on opposite sides of said first insulative member, said first and second flat recesses being between said first and second protuberances.

3. The electrical connector of claim 1 and further including:
   - complementary guide means on said first and second insulative members for aligning said first and second protuberances with said first and second apertures, respectively.

4. The electrical connector of claim 3 and further including:
   - first and second flat recesses disposed on opposite sides of said first insulative member, said first and second flat recesses being between said first and second protuberances.

5. The electrical connector of claim 1 wherein said electrical output means comprises:
   - a third insulative member identical to said first insulative member and said second insulative member has third and fourth apertures therein for cooperation with said third insulative member.

6. The electrical connector of claim 5 and further including:
   - complementary guide means on said first and second insulative members for aligning said first and second protuberances with said first and second apertures, respectively.

7. The electrical connector of claim 5 and further including:
   - first and second flat recesses disposed on opposite sides of said first insulative member, said first and second flat recesses being between said first and second protuberances.

8. The electrical connector of claim 7 and further including:
   - complementary guide means on said first and second insulative members for aligning said first and second protuberances with said first and second apertures, respectively.

* * * * *